US008344891B2

(12) United States Patent
Appalucci et al.

(10) Patent No.: US 8,344,891 B2
(45) Date of Patent: Jan. 1, 2013

(54) SECURITY HARD TAG WITH ATTACHMENT CLIP AND METHOD FOR ATTACHING AND DETACHING

(75) Inventors: Lawrence Appalucci, Villanova, PA (US); Anthony F. Piccoli, West Deptford, NJ (US); Gary Mazoki, Sewell, NJ (US); Thomas J. McKeown, Pennsauken, NJ (US); James Brodzik, Somerdale, NJ (US)

(73) Assignee: Checkpoint Systems, Inc., Thorofare, NJ (US)

( * ) Notice: Subject to any disclaimer, the term of this patent is extended or adjusted under 35 U.S.C. 154(b) by 805 days.

(21) Appl. No.: 12/482,934

(22) Filed: Jun. 11, 2009

(65) Prior Publication Data

US 2010/0225485 A1 Sep. 9, 2010

Related U.S. Application Data

(60) Provisional application No. 61/157,237, filed on Mar. 4, 2009, provisional application No. 61/163,677, filed on Mar. 26, 2009.

(51) Int. Cl.

| | |
|---|---|
| ***G08B 13/14*** | (2006.01) |
| ***B21D 53/46*** | (2006.01) |
| ***B21K 1/44*** | (2006.01) |

(52) U.S. Cl. ..... 340/572.9; 340/568.1; 340/568.4; 340/572.1; 340/572.8; 29/3; 29/7

(58) Field of Classification Search ..... None
See application file for complete search history.

(56) References Cited

U.S. PATENT DOCUMENTS 4,502,305 A * 3/1985 Bakker ..... 70/49
(Continued)

FOREIGN PATENT DOCUMENTS

CN 201122327 Y 9/2008
(Continued)

OTHER PUBLICATIONS

International Search Report for corresponding PCT Application No. PCT/US2009/047245 dated Oct. 20, 2009.

(Continued)

*Primary Examiner* — Julie Lieu
(74) *Attorney, Agent, or Firm* — Caesar, Rivise, Bernstein, Cohen, Pokotilow, Ltd.

(57) ABSTRACT

A security hard tag, uses an attachment clip to couple to an article, such as but not limited to clothing, to be protected and which can only be released from the article by use of an authorized detacher that is inserted into the security hard tag. The attachment clip may include various types of locking mechanisms on its two ends, one end which is permanently secured within the security hard tag housing and the other end which is releasably secured within the housing. Before being releasably secured within the housing, the one end is inserted through or around a portion of an article, or through a security tag loop attached to the article, and then that end is locked into the housing. The detacher uses a cam, either located on the detacher itself or positioned within the security hard tag housing, to interact with the one end of the attachment clip to release the locked end. The housing also includes a security element that may comprise EAS (including AM, RF, EM and microwave), RFID (including LF, HF and UHF), benefit denial (e.g., ink-filled or dye-filled capsules) or any combination thereof. A preferred embodiment of the security hard tag uses all non-ferrous components including its locking mechanism. The non-ferrous composition of the security hard tag, along with the attachment clip design, forms a security hard tag that is strong and lightweight, thereby providing a low impact presentation of a security hard tag with an article.

56 Claims, 14 Drawing Sheets

U.S. PATENT DOCUMENTS

| | | | | |
|---|---|---|---|---|
| 4,546,345 | A | 10/1985 | Naito | |
| 5,070,581 | A | 12/1991 | Senter | |
| 5,081,446 | A * | 1/1992 | Gill et al. | 340/572.5 |
| 5,508,684 | A | 4/1996 | Becker | |
| 5,515,580 | A | 5/1996 | McHenry, Jr. | |
| 5,524,463 | A | 6/1996 | Schenkel et al. | |
| 5,583,489 | A | 12/1996 | Loemker et al. | |
| 5,615,454 | A | 4/1997 | Contarino | |
| 5,627,520 | A | 5/1997 | Grubbs et al. | |
| 5,699,591 | A | 12/1997 | Kane | |
| 6,052,876 | A | 4/2000 | Hogan et al. | |
| 6,188,320 | B1 | 2/2001 | Kolton et al. | |
| 6,254,953 | B1 | 7/2001 | Elston | |
| 6,380,855 | B1 | 4/2002 | Ott | |
| 6,624,753 | B2 | 9/2003 | Elston | |
| 6,780,265 | B2 | 8/2004 | Bleckmann et al. | |
| 7,129,841 | B2 * | 10/2006 | Feibelman | 340/568.1 |
| 7,183,914 | B2 | 2/2007 | Norman et al. | |
| 7,183,917 | B2 | 2/2007 | Piccoli et al. | |
| 7,227,467 | B2 | 6/2007 | Feibelman | |
| 7,456,741 | B2 | 11/2008 | Norman et al. | |
| 7,518,521 | B2 | 4/2009 | Feibelman et al. | |
| 7,808,390 | B2 | 10/2010 | Sayegh | |
| 8,035,518 | B2 * | 10/2011 | Kolton et al. | 340/572.1 |
| 2003/0052782 | A1 * | 3/2003 | Maloney | 340/568.4 |
| 2005/0128089 | A1 * | 6/2005 | Feibelman | 340/572.9 |
| 2006/0026809 | A1 | 2/2006 | Copen et al. | |
| 2006/0238343 | A1 * | 10/2006 | Leyden et al. | 340/572.1 |
| 2007/0067971 | A1 * | 3/2007 | Nguyen et al. | 24/704.1 |
| 2009/0135014 | A1 | 5/2009 | Bleckmann et al. | |
| 2010/0225485 | A1 * | 9/2010 | Appalucci et al. | 340/572.9 |
| 2010/0308998 | A1 * | 12/2010 | Hesch et al. | 340/572.8 |
| 2011/0018716 | A1 * | 1/2011 | Piccoli et al. | 340/572.9 |
| 2012/0019385 | A1 * | 1/2012 | Brodzik et al. | 340/572.9 |
| 2012/0032805 | A1 * | 2/2012 | Brodzik et al. | 340/572.8 |

FOREIGN PATENT DOCUMENTS

| | | |
|---|---|---|
| EP | 1548640 | 6/2005 |
| EP | 1171300 | 9/2005 |
| GB | 2187706 | 9/1987 |
| GB | 2305212 | 4/1997 |
| JP | 2002074530 | 3/2002 |
| KR | 20030079036 | 10/2003 |
| KR | 20050020918 | 3/2005 |
| WO | 98/40591 | 9/1998 |
| WO | 2006/127674 | 11/2006 |
| WO | 2008/068725 | 6/2008 |

OTHER PUBLICATIONS

International Search Report for related PCT Application No. PCT/US2011/051593 dated Feb. 17, 2012.

* cited by examiner

FIG.1
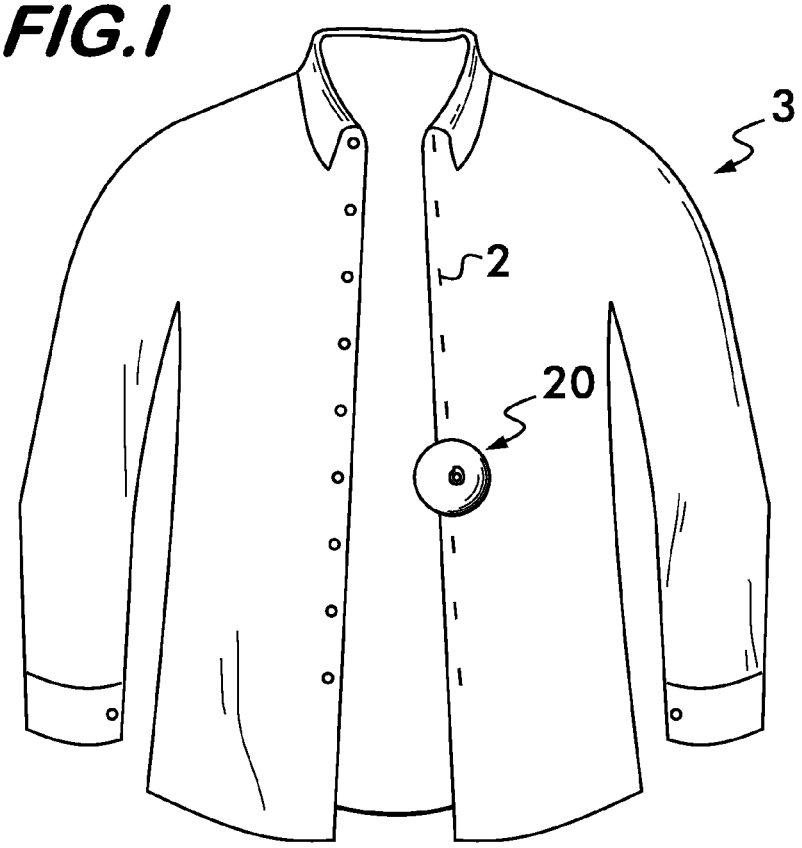
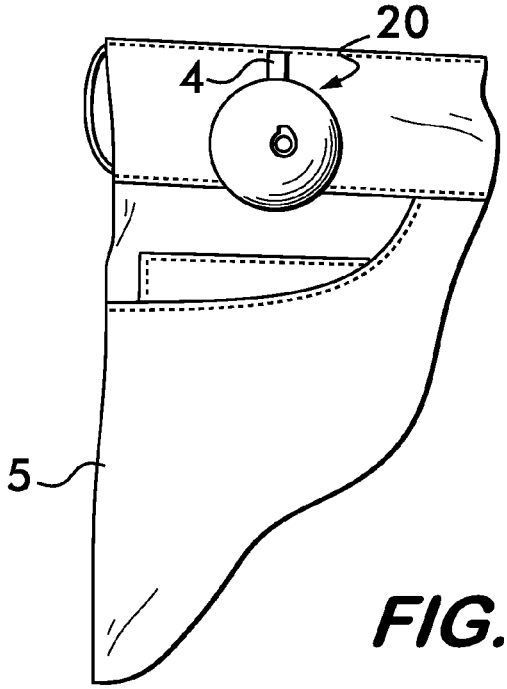
FIG.2

SECURITY HARD TAG WITH ATTACHMENT CLIP AND METHOD FOR ATTACHING AND DETACHING

CROSS-REFERENCE TO RELATED APPLICATIONS

This utility application claims the benefit under 35 U.S.C. §119(e) of Provisional Application Ser. No. 61/157,237 filed on Mar. 4, 2009 entitled NON-FERROUS HARD TAG and of Provisional Application Ser. No. 61/163,677 filed on Mar. 26, 2009 also entitled NON-FERROUS HARD TAG and both of whose entire disclosures are incorporated by reference herein.

BACKGROUND OF THE INVENTION

1. Field of Invention

The present invention generally relates to the field of security tags, and more particularly, to hard tags which are releasably attached to an article and then later removed only via an authorized detacher.

2. Description of Related Art

Many apparel items are tagged (i.e., a security device or element applied) at the source.

These security devices may comprise electronic article surveillance (EAS) elements, radio frequency identification (RFID) elements or combinations of such security devices, etc., and which can be wirelessly detected at business portals, e.g., store exits or points of sale (POS), etc. to prevent or diminish theft from the business. Most conventional hard tags on the market utilize a metallic pin and lock mechanism to secure the tag to an article (e.g., clothing) for protecting the article against theft. Once the hard tag is then installed on or with the article, to prevent any broken sewing needle from imbedding itself into the clothing and possibly causing harm to the end user, especially children, the article is subjected to a required needle detector test. The needle detector (e.g., the HN-25 Needle Detector by Hashima Co. Ltd. of Japan) senses a change in magnetic field and alarms if a ferrous metal enters into its sensing field; these detectors typically have two settings based on the quantity of iron in a steel ball of 0.8 mm (high) or 1.2 mm (low). There are also significant legal liabilities if a broken needle leaves the factory.

In addition, the actual tagging of the security device/element to the apparel "impacts" the apparel by either puncturing the apparel (e.g., pin and receptacle) or by being adhesively secured to the apparel, or by being embedded (e.g., sewn) within the apparel. Not only does this create an undesirable effect (e.g., a puncture hole, a distortion, etc., in the apparel material) but it also disturbs the presentation of the apparel when displayed in the business. For example, the attachment of the security device/element to the apparel may distort or wrinkle the fabric when the apparel is positioned on the hanger, the mannequin, or other display methods. Such an uninviting display actually discourages patrons from even considering trying on the apparel, thereby losing a potential sale.

This is most apparent in many apparel items such as intimates, bathing suits and accessories but also occurs with soft goods. Soft goods include homeware items such as bedding, towels, fabrics, etc. Thus, these types of goods do not favor the known security devices and methods for attaching such devices due to the size of the goods or the invasive nature of the products known in the art. The attachment of a security device embedded in packaging for apparel, linens and soft goods is known in the art. A woven label such as that shown in U.S. Pat. No. 6,780,265 (Bleckmann, et al.) has an embedded EAS or RFID device.

The method of attaching such a woven label by a sewing machine is also known in the art. Other methods are disclosed where the device is embedded within a paper ticket, price tag or hang tag (swing ticket). These products are also attached by known methods. By way of example, see U.S. Pat. No. 5,508,684 (Becker); U.S. Pat. No. 5,583,489 (Loemaker, et al.); U.S. Pat. No. 6,254,953 (Elston); and EP 1171300 (Bleckmann, et al.).

Moreover, where RFID security devices are used, many people have an apprehension with such devices when they are used in connection with personal items because it harbors connotations of invasion of privacy. RFID security devices typically include a memory regarding the item itself. Where such security devices are sewn into apparel, people are reluctant to purchase apparel that may permanently contain a device that may store information and which cannot be removed without damaging the apparel. Thus, the use of RFID security devices tends to increase the "impact" of such security devices on apparel.

Thus, there remains a need for a hard tag that does not utilize any metallic pin that may cause harm to the wearer of the article while simultaneously always passing the needle detector test. At the same time, there also remains a need for a providing a security tag that can be secured to elegant items or soft goods without having to pierce, puncture or adhesively attach to such items, i.e., that provide a "zero or low impact" to such items and that minimize invasion of privacy concerns for customers. In addition, the hard tag needs to minimize the number of elements that are disengaged from the hard tag when being released from the articles they are protecting.

BRIEF SUMMARY OF THE INVENTION

A security hard tag adapted for securing to an article (e.g., an article such as, but not limited to clothing, especially children's clothing, etc.), and wherein the security tag comprises: a housing; a locking mechanism contained within the housing; an attachment clip having ends that secure within the locking mechanism and wherein one of the ends is passed through or around the article being protected before that end is secured within the housing; and a security element (e.g., EAS (including AM, RF, EM and microwave), RFID (including LF, HF and UHF), benefit denial (e.g., ink-filled or dye-filled capsules) or any combination thereof, etc.) associated the housing, and wherein the security element prevents or hinders a theft of the article.

A method for attaching a security hard tag to an article (e.g., an article such as, but not limited to clothing, especially children's clothing, etc.), and wherein the method comprises: providing a housing comprising a locking mechanism and a security element associated therewith (e.g., EAS (including AM, RF, EM and microwave), RFID (including LF, HF and UHF), benefit denial (e.g., ink-filled or dye-filled capsules) or any combination thereof, etc.), wherein the security element prevents or hinders a theft of the article; locking a first end of an attachment clip within the housing; passing a second end of the attachment clip through or around the article; and releasably securing the second end of the attachment clip into the housing.

A loop provided in an article (e.g., an article such as, but not limited to clothing, especially children's clothing, etc.) to which a security tag may be coupled and wherein the loop is located in a concealed portion of the article when the article is on display or presentation, and wherein the loop is fixedly or releasably secured to the article and around or through which a security tag can be coupled.

BRIEF DESCRIPTION OF SEVERAL VIEWS OF THE DRAWINGS

The invention will be described in conjunction with the following drawings in which like reference numerals designate like elements and wherein:

FIG. 1 depicts the hard tag of the present invention secured to an article of clothing (e.g., a shirt) via a button hole;

FIG. 2 depicts the hard tag of the present invention secured to another article of clothing (e.g., pants) via a belt loop;

DETAILED DESCRIPTION OF THE INVENTION

Figure 3:
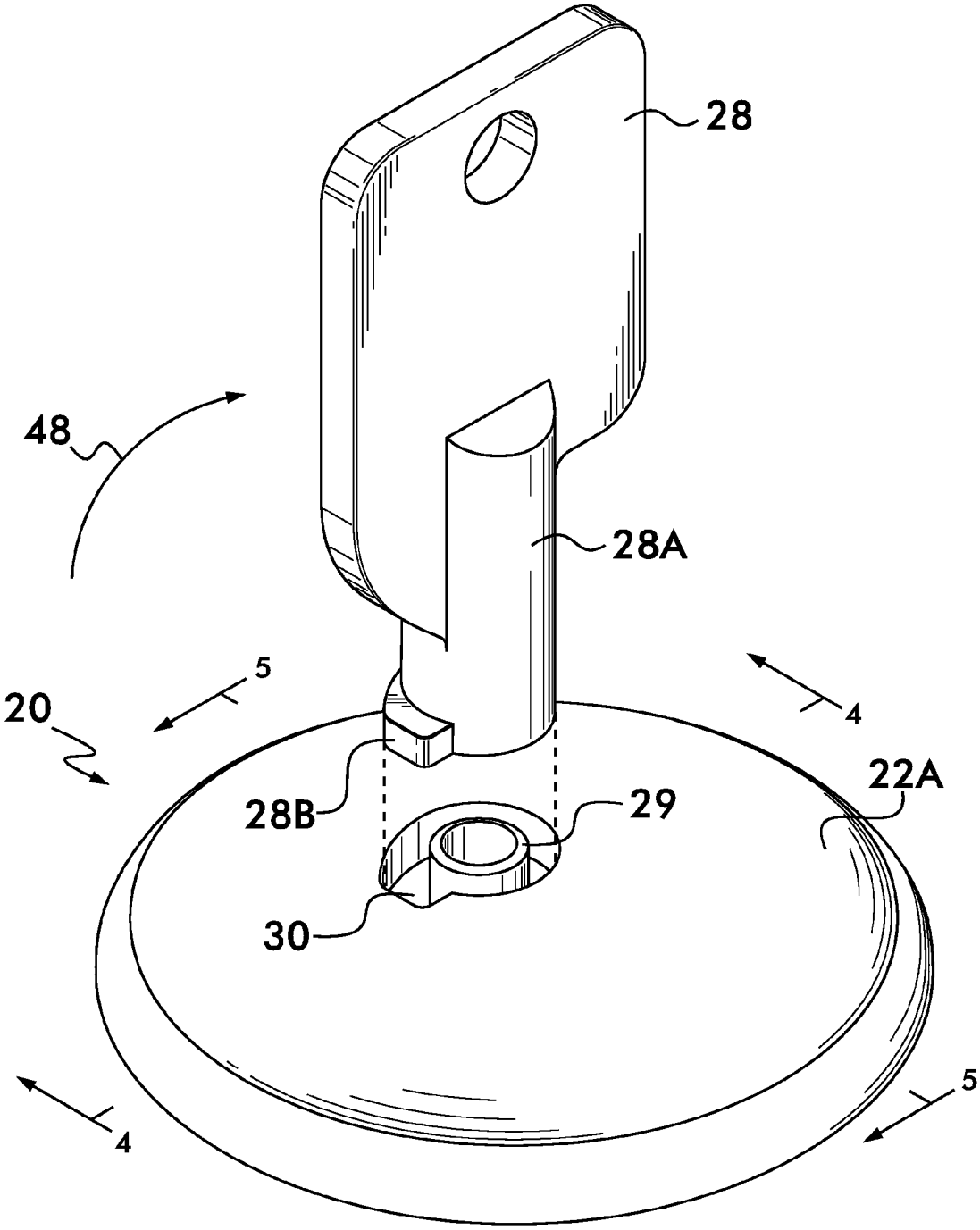
FIG. 3 is an enlarged isometric view of the hard tag of the present invention showing a detacher being inserted into the hard tag for releasing it from the article of clothing.

The present invention provides a novel security hard tag that can be attached to a variety of items with minimal impact to the presentation of the article to potential customers of the article, reducing the weight of conventional hard tags, complying with needle tests, reducing the number of detachable parts and being versatile to include any type of security element technology such as, but not limited to: EAS (electronic article surveillance, which includes AM, RF, EM and microwave), RFID (radio frequency identification, which includes LF, HF and UHF), benefit denial (e.g., ink-filled or dye-filled capsules that eject ink/dye upon illicit attempts to remove capsule, or visual alarm, or audible alarm or tactile alarm or any item that cannot be removed from the article (unless the article is validly purchased) that hinders or prevents the theft and/or denies the benefit of the article to the would-be thief) or any combination thereof. Therefore, whether the security element involves wireless transmissions (e.g., responding to a magnetic or electromagnetic field of a particular frequency or frequencies, or operates independently of any wireless transmissions (e.g., benefit-denial, visual/audible/tactile alarms, or anything that would draw attention to the non-authorized possession of the article, etc.), the term "security element" as used throughout the specification is meant to include any and all of these types of theft prevention-hindrance-benefit denial devices. Furthermore, it should be understood that in all of the subsequent discussion, the type of security element associated with the novel security tag forms no limitation on the invention.

As will also be discussed later, even when the hard tag is released from securement to the article it is protecting, there is no complete disengagement of an attachment clip from the hard tag; rather, the attachment clip is disengaged such that the article can be separated from the hard tag but the attachment clip remains secured to the hard tag. This prevents the loss of the attachment clip and also avoids creating a chocking hazard that would most likely occur if the clip completely disengaged from the hard tag and an infant or toddler found the disengaged attachment clip.

The present invention also satisfies a need, especially in the baby clothing sector, for a low cost non-ferrous hard tag that can be easily attached (e.g., at the garment manufacturer, or at the retail outlet, etc.) and detached at the point of sale (POS) within the retail store. The non-ferrous parts are needed because where the security hard tag of the present invention is manually attached to the article at the manufacturer, the article with the security hard tag is subjected to the needle test. Thus, use of the security hard tag of the present invention permits the attachment of the hard tag at the garment manufacturing site while greatly reducing failures of the needle test.

Another one of the important features of the present invention 20 is that it is lightweight, (e.g., less then 5 grams) thereby minimizing the impact it has on articles that are hung or otherwise displayed for customer consideration. By way of example only, as shown in FIGS. 1 and 2, the security hard tag 20 is shown releasably secured to a shirt (FIG. 1) or to a belt loop on a pants garment. As will be discussed in detail later, the security hard tag's attachment clip can be positioned through a button hole 2 of a shirt 3 or around belt loop 4 of a pants garment 5. Because the security hard tag 20 is lightweight, it does not cause the shirt or pants to droop or sag, thereby providing a nice impression or display for customers.

Figure 19:
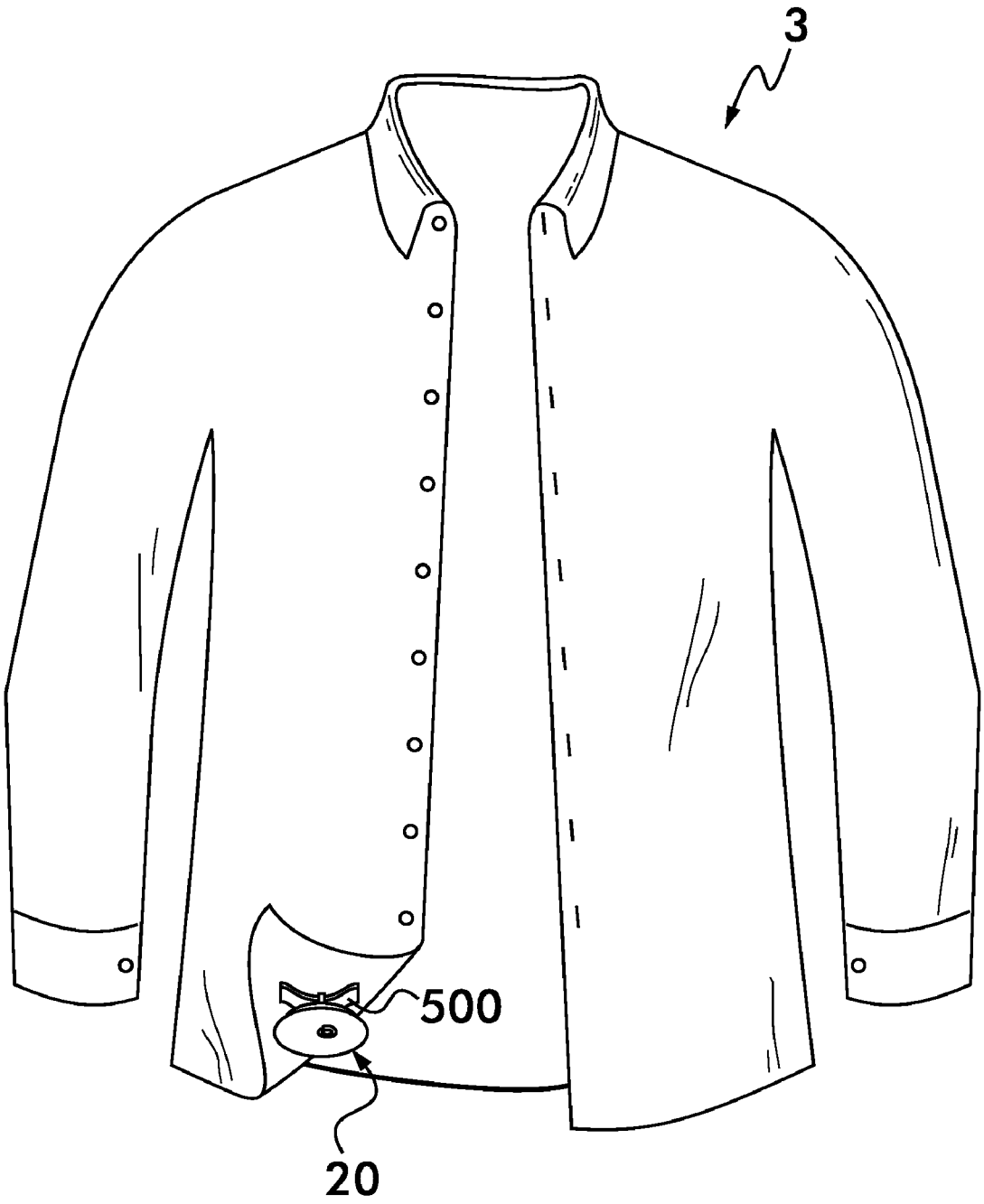
FIG. 19 shows the coupling of a security tag loop to an article of clothing for coupling any type of security tag to the article of clothing in a somewhat concealed manner.

In addition, a security tag loop 500 may be fixedly or releasably provided on the article for the purpose of coupling a security tag thereto, as shown in FIG. 19. This loop is positioned at a location on or within the article that is concealed from view when the article is on display. As shown in FIG. 19, by way of example only, this security tag loop 500 is secured on the inside layer of a shirt 3 such that when a security tag (e.g., the security hard tag 20 of the present invention) is coupled thereto, the security tag is not visible upon viewing the article in a displayed presentation. With the security hard tag 20 of the present invention coupled to the loop 500, the low impact effect of the tag 20 makes it nearly imperceptible to an approaching customer. Such loops 500 can be positioned at any location on the article, although a preferred location is one that is typically concealed when the article is being hung or otherwise presented to customers for purchase.

The shape of the security hard tag 20 is shown as a round shape but it should be understood that that is only by way of example and that an unlimited number of shapes (e.g., rectangular, triangular, etc.) can be used for the security hard tag 20. Regardless of the selected shape for the security hard tag 20, the size of the tag 20 is large enough (e.g., it has an outer dimension greater than 31.9 mm, the choking threshold standard) to avoid being a choking hazard to an infant or toddler.

Figure 4:
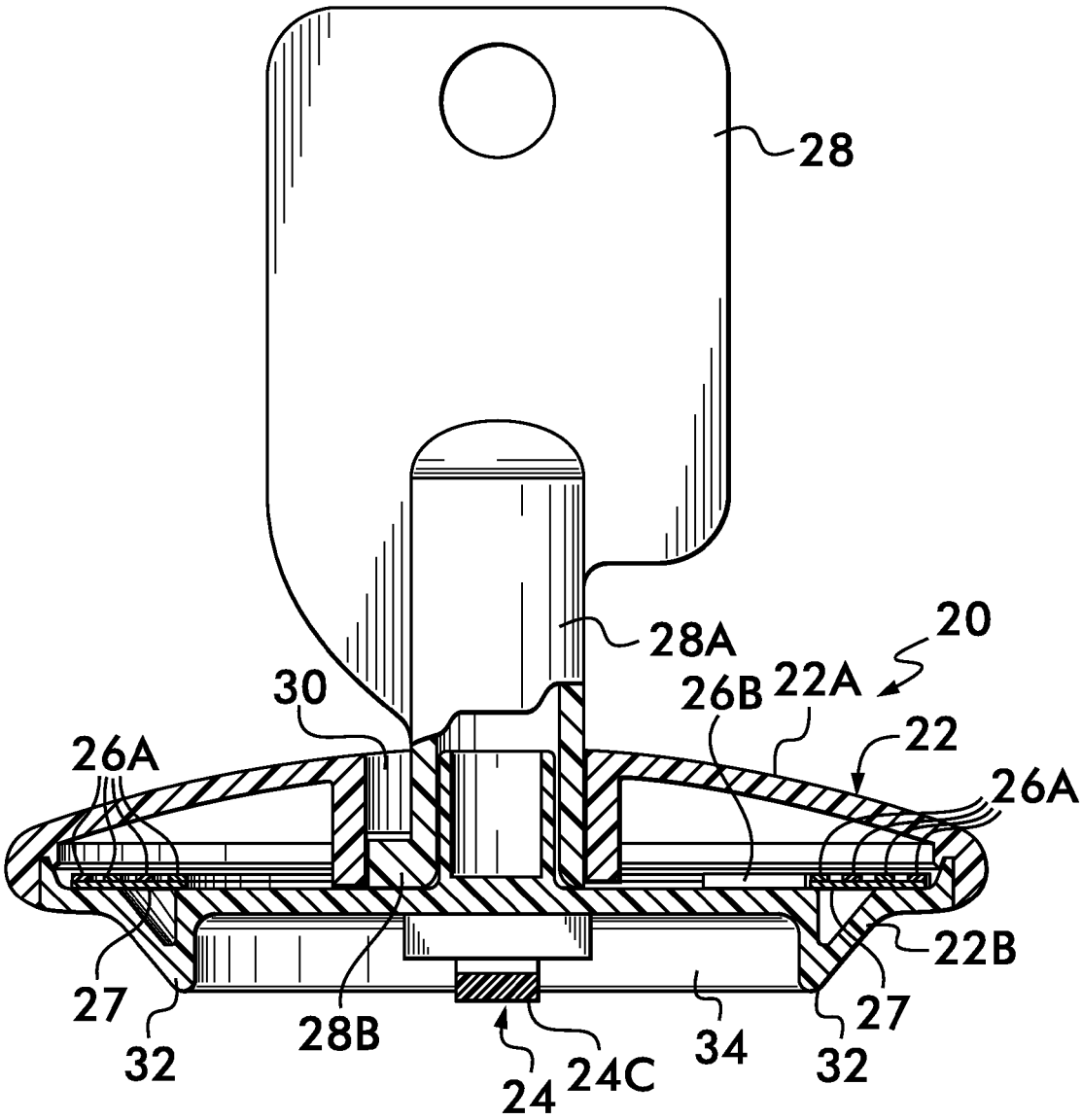
FIG. 4 is a side cross-sectional view of the hard tag of the present invention taken along line 4-4 of FIG. 3 and showing the detacher inserted within but not rotated.
Figure 5:
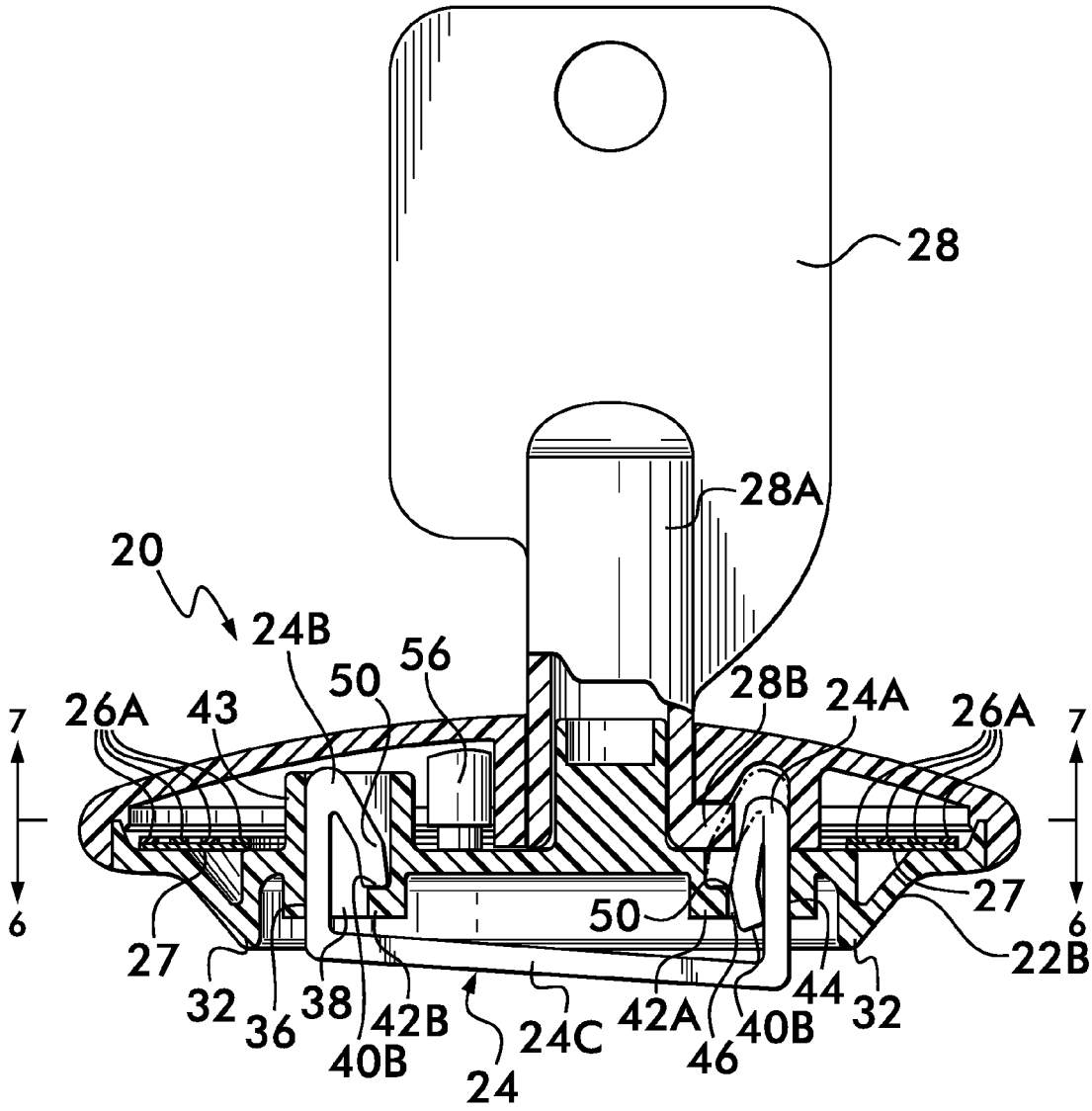
FIG. 5 is a side cross-sectional view of the hard tag of the present invention taken along line 5-5 of FIG. 3 and showing the detacher unlocking one end of the attachment clip which has also been displaced or "popped" out of the aperture.
Figure 12:
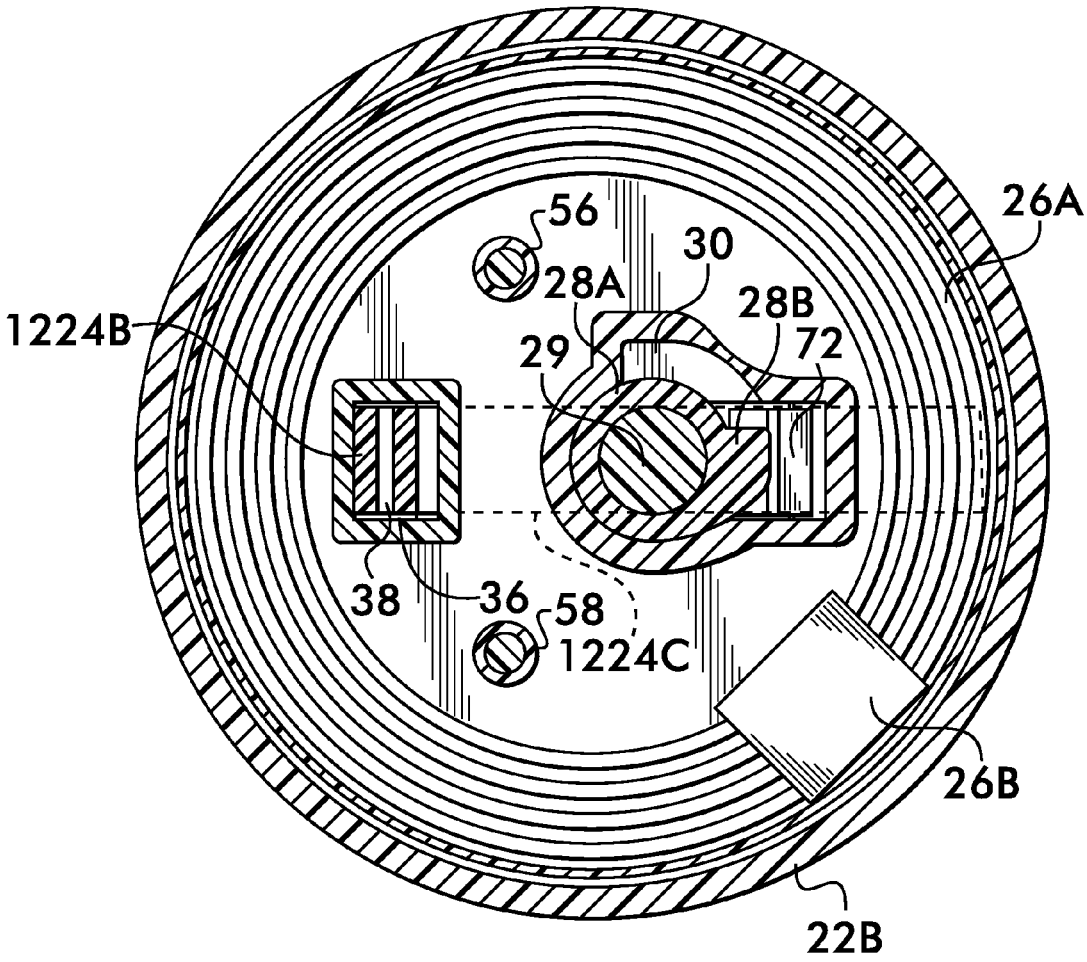
FIG. 12 is a plan cross-sectional view taken along line 12-12 of FIG. 11.

As shown most clearly in FIGS. 3-5, the invention 20 comprises a hard tag housing 22 which comprises a first portion 22A and a second portion 22B that are fixedly secured (e.g., ultrasonically welded) together. Within the housing 22 is a non-ferrous locking mechanism which captures the ends of an attachment clip 24 (FIG. 5) which releasably secures a portion of an article or other item between the second portion 22B and the attachment clip 24. Also within the housing 22 is a security element 26. As mentioned previously, by way of example only, the security element 26 may comprise an EAS element comprising a coil 26A and capacitor 26B (see FIGS. 6, 12 and 15). The coil 26A/capacitor 26B are formed on a substrate layer 27 that permits the security element 26 to be manipulated during assembly. The coil 26A is positioned within the second portion 22B. As mentioned previously, the security element 26 may comprise a variety of security elements such as but not limited to RF, RFID, AM, etc., and may include an antenna in place of the coil 26A. The components of the security element 26 are typically aluminum and/or copper, i.e., non-ferrous, so there is no possibility of the needle detector test being triggered by the presence of the security element 26. The security tag 26 is positioned within the housing 22 to avoid any interference with the lock mechanism or with attachment clip ends' entry/egress during use. Thus, should a thief attempt to remove the article with the security hard tag 20 still coupled to the article, pedestals (not shown) at the retail establishment exit (also not shown) will detect the presence of an internal security element 26 and set off an alarm.

A detacher 28 is used to release one of the ends of the attachment clip 24 in order to remove the security hard tag 20 from the article that it is protecting. Possession of the detacher 28 is provided to a trusted person (e.g., store manager or employee, etc.) that inserts it into an opening 30 in the security tag 20 and then rotates the detacher 28 to release one of the attachment clip ends, as will be discussed later. The detacher 28 comprises a shank 28A at whose distal end is a cam 28B. Furthermore, the second portion 22B includes a central post 29 over which the shank 28A of the detacher 28 is inserted and is rotatably movable about the post 29. The cam 28B interacts with a portion of the attachment clip end or other mechanisms within the housing 22 to release that end of the attachment clip 24 and to permit the security hard tag 20 to be released from the article or item. It should be understood that although the detacher 28 is shown in the figures as a "key-style" configuration that only indicates a portion of the overall detacher and specifically the figures only depict the portion of the detacher 28 that engages the invention 20. Thus, the detacher 28 may comprise a component that is fixedly secured at the point of sale (POS) and which includes a portion that is shown in the figures of this Specification for engaging the invention 20 when removal of the invention from the article is to be accomplished. In addition, a lever or other type of mechanism or automated mechanism may be used to activate the detacher 28 when engaged with the invention 20 to release it from the article.

Figure 18:
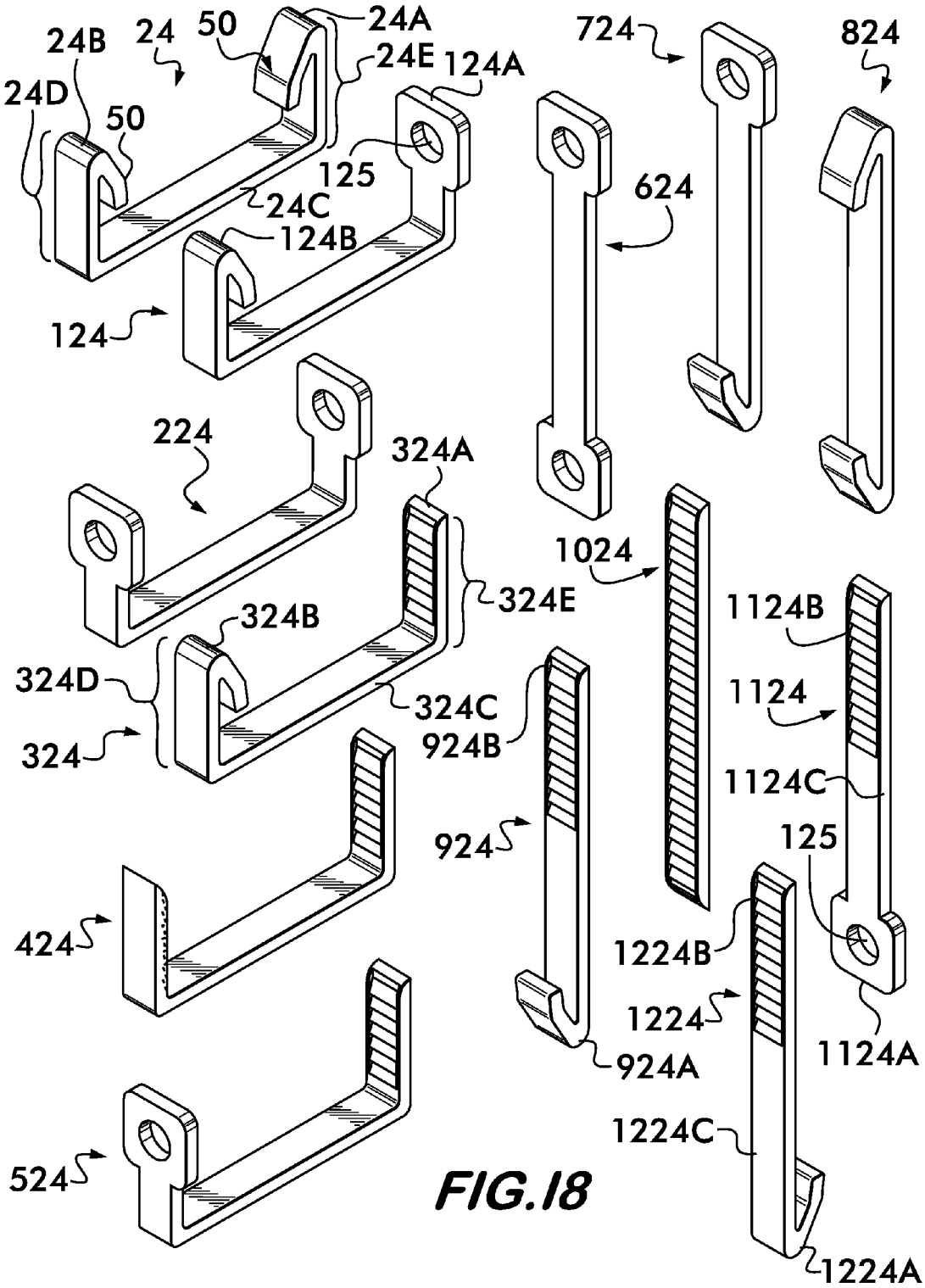
FIG. 18 depicts a variety of attachment clips that can be used with the hard tag of the present invention.

As shown most clearly in FIG. 5, the attachment clip 24 is shown where one of its ends 24A has been released from capture within the housing 22 and has even "popped" out of the housing 22, thereby allowing the trusted person to further displace the released end 24A and remove a portion of the article (not shown) that was trapped between a clip segment 24C and the bottom of the housing 22. The other end 24B of the attachment clip 24 remains captured within the housing 22. As will be discussed later, various types of attachment clips may be used with the security hard tag 20. FIG. 18 shows different variations of the attachment clip that can be used. In addition, different sizes of attachment clips can be used and may be even be color-coded to distinguish between size for coupling to different types of merchandise.

Another theft prevention feature of the present invention 20 is the presence of a "skirt" 32 that depends away from the second portion 22B of the housing. As can be seen most clearly in FIG. 4, with both ends 24A/24B of the attachment clip 24 fully captured within the housing 22, the clip segment 24C is positioned within a cavity 34 formed by the skirt 32. The skirt 32 hinders a would-be thief from attempting to insert a pair of cutting jaws (e.g., scissors, wire cutter, etc.) around the top and bottom surfaces of the clip segment 24C and trying to cut the clip segment 24C.

The attachment clip 24, as well as the housing 22, are plastic. In fact, all portions, internal and external, of the housing 22, i.e., the first portion 22A and the second portion 22B comprise plastic (e.g., polyethylene, PVC (poly vinyl chloride) including polymers, other plastic materials, acrylonitrile-butadiene-styrene). In the preferred embodiment, there are no ferrous materials contained within or outside of the invention 20. The ends of the attachment clip 24 (as will be explained shortly) along with structure in the housing 22, form a plastic locking mechanism for the security hard tag 20. The attachment clip 24 (see FIG. 18) has bent or "hooked" ends 24A and 24B which are hereinafter referred to as "flukes" that have stems 24D/24E (see FIG. 18) which form right angles with the clip segment 24C. As shown in FIG. 5, during initial assembly of the security hard tag 20, one of the flukes (e.g., 24B) is slid through an aperture 36 where the fluke 24B is initially compressed as it passes through an opening 38 and then flexes open again such that the extreme end of the fluke, barb edge 40B, is locked against a stop 42B in the second portion 22B. The other fluke 24A, which is still free, is then passed through an opening in the article (e.g., the button hole 2 of a shirt, FIG. 1; a belt loop 4 of a pants garment, FIG. 2; the security tag loop 500, FIG. 19, etc.) and then the free end fluke 24A is pushed through an aperture 44 where the fluke 24A is initially compressed as it passes through an opening 46 and then flexes open again such that its barb edge 40A gets trapped against a stop 42A in the second portion 22B. As also shown in FIG. 5, an aperture wall 43, along with the stop (42A/42B) thickness (e.g., approximately ½ inch), form a fluke support that resists the deformation of the flukes 24A/24B should a would-be thief attempt to pull or tug on the attachment clip 24 to disengage it from the housing 22. Also, depending on the thickness of the portion of the article (not shown) being trapped by the clip segment 24C, attachments clips 24 having different stem 24D/24E lengths are selected; e.g., one method is to color code the attachment clips 24 of different stem sizes.

FIG. 5 also depicts how the security hard tag 20 is released from the article (not shown) to which the tag 20 is secured. When the detacher 28 is inserted into the opening 30, over the central post 29, and then rotated in the direction 48 (FIG. 3), the cam 28B compress the fluke 24A, causing it to temporarily deform to permit passage out of the opening 46 of the aperture 44. It should be further noted that because the fluke 24A contains a bridge line 50 between two non-aligned segments of the barb, when the cam 28B pushes against that bridge line 50 during rotation of the detacher 28, the fluke 24A is not simply compressed but is compressed and driven partially out of the aperture 44, thereby allowing the trusted person to grip the released fluke 24A and clip segment 24C to release the security hard tag 20 from the article (not shown) to which it had been attached. FIG. 5 depicts this "popped out" condition after the cam 28B has compressed the fluke 24A along the bridge line 50. This feature of not only unlocking the fluke 24A but partially "popping" it out from the aperture 44, permits the trusted person to conceal the insertion of the detacher 28 when releasing the security hard tag 20 and then to manually completely pull out the released fluke 24A to release the article attached thereto. For example, when an article is validly purchased at the POS, the trusted person can place the article (with the security hard tag 20 attached thereto) under the POS counter, where he/she inserts the detacher 28 (out of the view of the customer) into the opening 30, rotates it and then "feels" the released fluke 24A, removes the detacher 28 and then brings everything back into view of the customer where the trusted person moves the attachment clip 24 slightly to release the security hard tag 20 from the purchased article. The customer thus never has an opportunity to see what the trusted person used to release the attachment clip 24. As can also be seen, the other fluke 24B remains locked in the housing 22, thereby avoiding any loose attachment clips 24 falling out of the housing 22 and thereby creating a possible choking hazard. The security hard tag 20 can then be attached to a new article or simply discarded.

Figure 6:
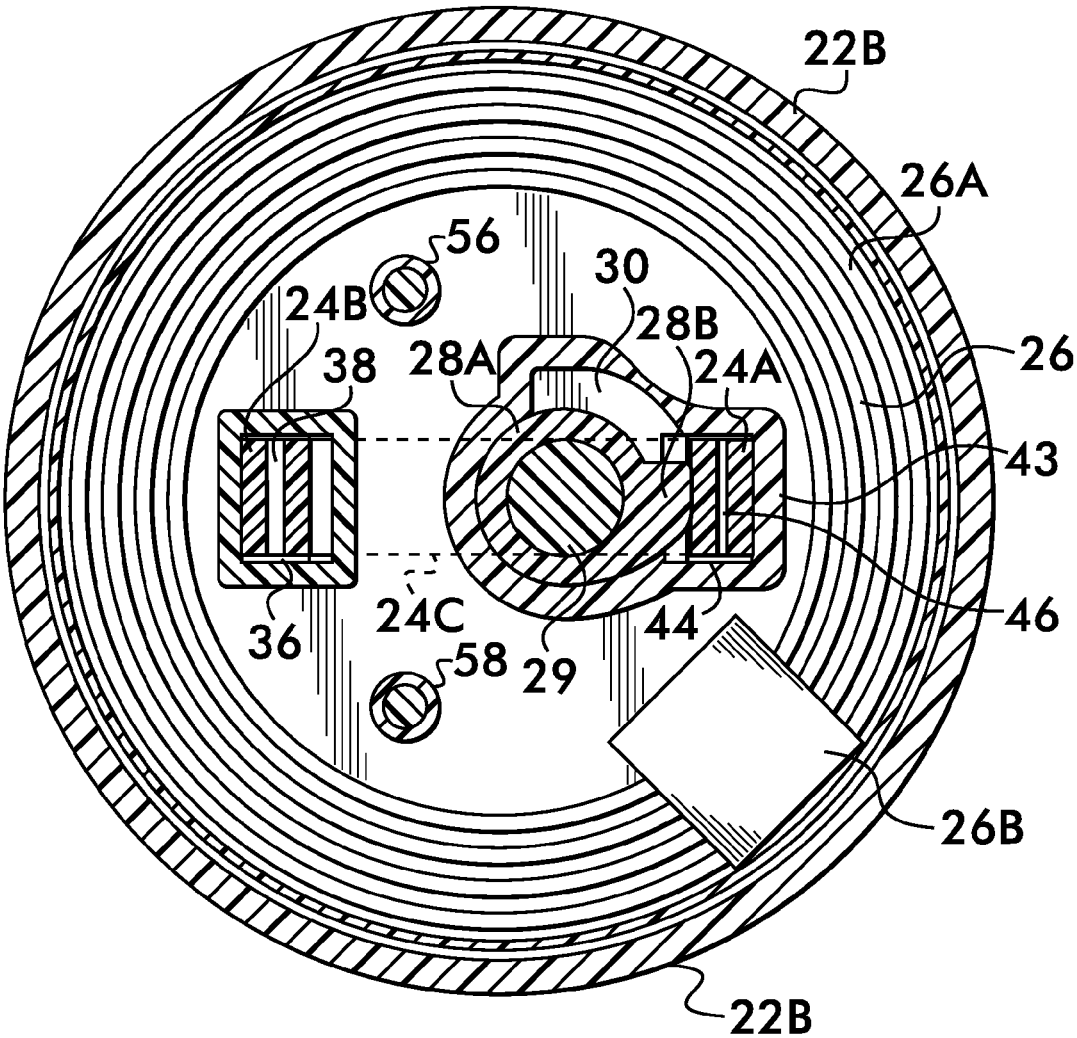
FIG. 6 is a cross-sectional view of the hard tag of the present invention taken along line 6-6 of FIG. 5 showing the flukes at each end of the attachment clip engaged within their respective apertures and also shows the circular security element positioned within the hard tag.
Figure 7:
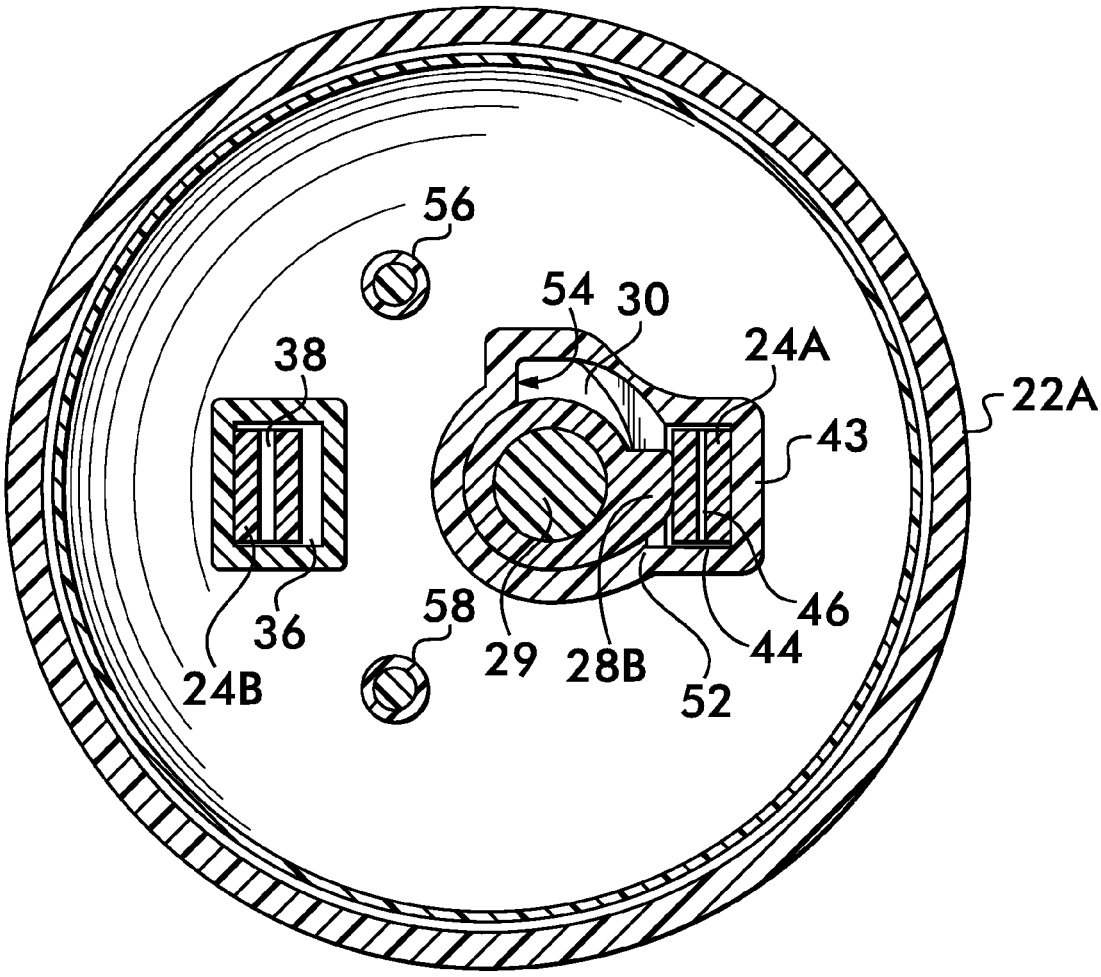
FIG. 7 is a cross-sectional view of the hard tag of the present invention taken along line 7-7 of FIG. 5 showing the detacher compressing one of the attachment clip's flukes to disengage and "pop" the fluke out of its aperture and which also shows the two stops of the detacher to prevent the detacher from over-travel in either the clockwise or counter-clockwise direction.

FIG. 6 is a cross-sectional view of the security hard tag 20 looking down through the second portion 22B showing the cam 28B compressing the fluke 24A. FIG. 7 is a cross-sectional view of the tag 20 looking upward through the first portion 22A showing the two stops of the cam 28B. In particular, with the cam 28B compressing the fluke 24A, the cam 28B is prevented from over-travelling and releasing the fluke 24A by a stop 52. Similarly, to prevent the cam 28B from being rotated in the opposite direction when it is first inserted, there is a stop 54. Therefore, upon insertion of the detacher 28, these stops provide tactile indicators for the trusted person to quickly insert the detacher 28 and release the security hard tag 20. Guide posts 56/58 facilitate alignment of housing portions 22A/22B during assembly.

As mentioned earlier, the attachment clip 24 is by way of example only. FIG. 18 shows a variety of other attachment clips (124-1224) that can be used with the security hard tag 20. The following discussion is directed to the operation of the security hard tag 20 using attachment clips 124, 1224 and 324, by way of example only, shown in FIGS. 8-15. It should be noted that letters "A" and "B" used with the attachment clip reference numbers 24-1224 (FIG. 18) refer to the two ends of the respective attachment clip, the letter "C" refers to the clip segment (or central portion of the attachment clip) and letters "D" and "E" refer to the right-angled stems, where they are present.

Figure 8:
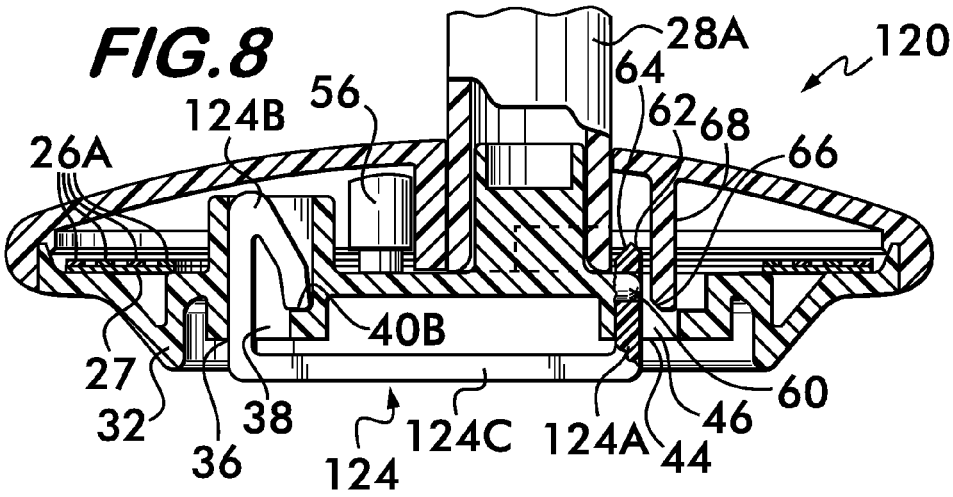
FIG. 8 is a cross-sectional view of the hard tag, similar to FIG. 5 but using a second variant of the attachment clip which uses a fluke on one end and a hole on the other.
Figure 9:
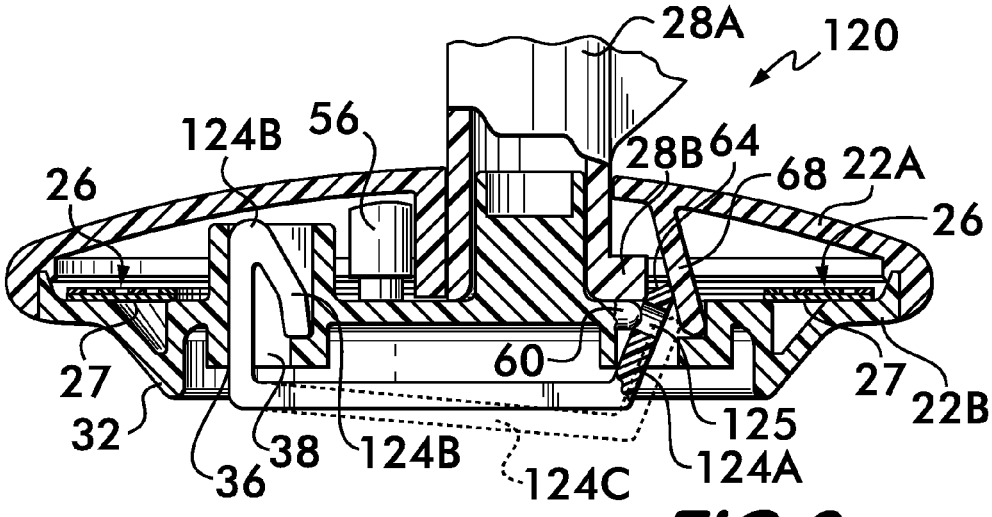
FIG. 9 is a cross-sectional view of the hard tag of FIG. 8 showing the rotation of the detacher disengaging the hole to release the attachment clip.

FIG. 8 shows a security hard tag 120 using an alternative attachment clip 124 which uses a fluke 124B at one end of the attachment clip segment 124C and an apertured end 124A. In particular, the fluke 124B is inserted into the aperture 36 and locked therein, as discussed previously. However, in this embodiment of the security hard tag, the release mechanism is designed for the releasable capture of the apertured end 124. An internal pin 60 is fixedly disposed within the second portion 22B so that it jutts into the opening 46 of the aperture 44. A top surface of the apertured end 124A comprises two tapers 62/64 that facilitate the insertion of the pin 60 into the hole 125 of the apertured end 124A; thus as the apertured end 124A is inserted into the opening 46, the first tapered edge 62 slides along a corresponding tapered edge 66 on a downwardly-depending, flexible flange 68 that facilitates moving the apertured end 124A into the opening 46. As the apertured end 124A progresses further, the second tapered edge 64 rides along the exterior of the pin 60 until the pin 60 seats within the hole 125 and the attachment clip 124 is locked therein. To unlock the attachment clip 124, the trusted person, inserts the detacher 28 and rotates it as discussed previously, until, as shown in FIG. 9, the cam 28B drives the upper portion of the apertured end 124A off of the pin 60. Movement of the upper portion of the apertured end 124A by the cam 28B, causes the apertured end 124B to displace the flexible flange 68. The trusted person can then pull on the released end and remove the article from the security tag 120. The security hard tag 120 can then be attached to a new article or simply discarded.

Figure 10:
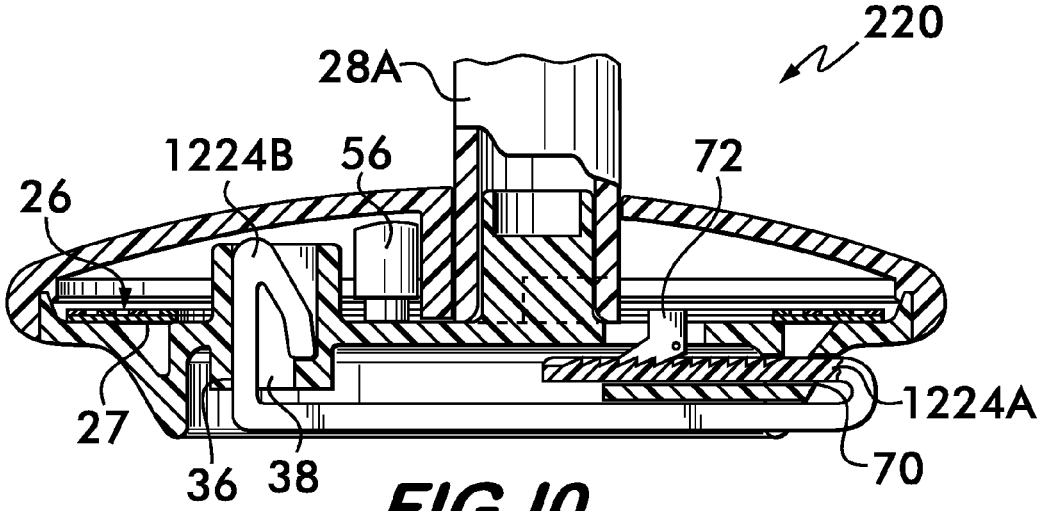
FIG. 10 is a cross-sectional view of the hard tag, similar to FIG. 5 but using a third variant of the attachment clip which uses a fluke on one end and ratchet teeth on the other and wherein the ratchet mechanism is engaged in a transverse manner rather than a perpendicular orientation.
Figure 11:
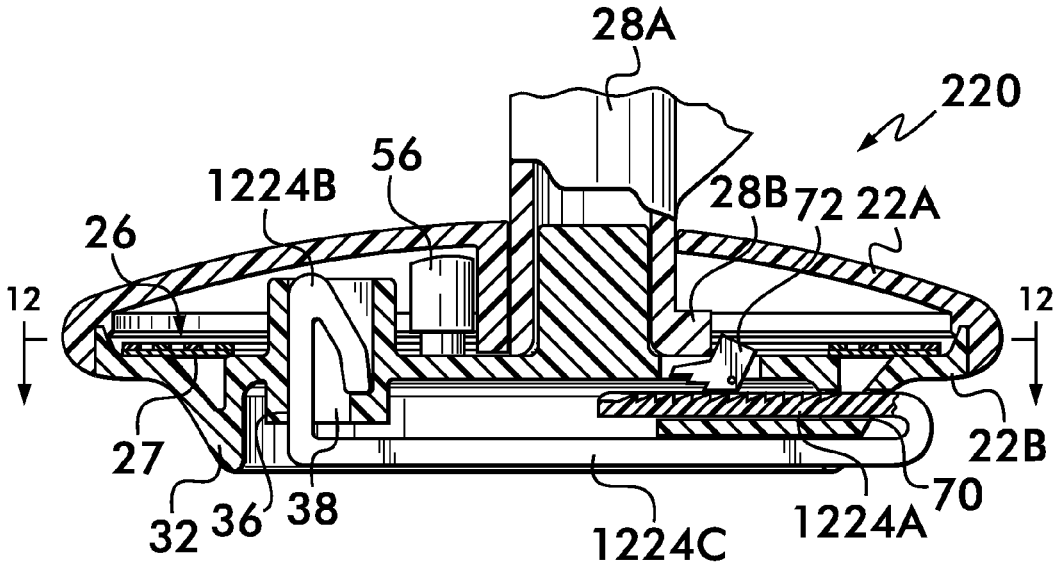
FIG. 11 is a cross-sectional view of the hard tag of FIG. 10 showing the rotation of the detacher disengaging the ratchet teeth to release the attachment clip.

FIGS. 10-11 depict another variation of the security hard tag 220 that uses a side-entry for one of the attachment clip 1224 ends. In particular, the attachment clip 1224 comprises a fluke end 1224B at one end, ratchet teeth at its other end 1224A and a clip segment 1224C. Unlike the previous attachment clips that have stems forming right ends with the flukes or apertured ends, the attachment clip 1224 can be manipulated in order to secure the fluke end 1224A into the housing 22 via the aperture 36/opening 38 as discussed previously. The other end 1224A is passed through or around the article (not shown; e.g., the button hole 2 of a shirt, FIG. 1; a belt loop 4 of a pants garment, FIG. 2; the security tag loop 500, FIG. 19, etc.) and then the other end 1224A is inserted into a slot 70 where the ratchet teeth interdigitate with corresponding teeth of a pivotable element 72 which locks the attachment clip 1224 within the housing 22. To remove the security hard tag 220 from the article, the detacher 28 is inserted into the opening 30 (FIG. 10) and then rotated (FIG. 11), which causes the cam 28B to pivot the pivotable member 72 out of contact with the ratchet teeth, thereby releasing the ratchet teeth of end 1224A. The end 1224A is then pulled out of the slot 70, releasing the security hard tag 224 from the article.

Figure 13:
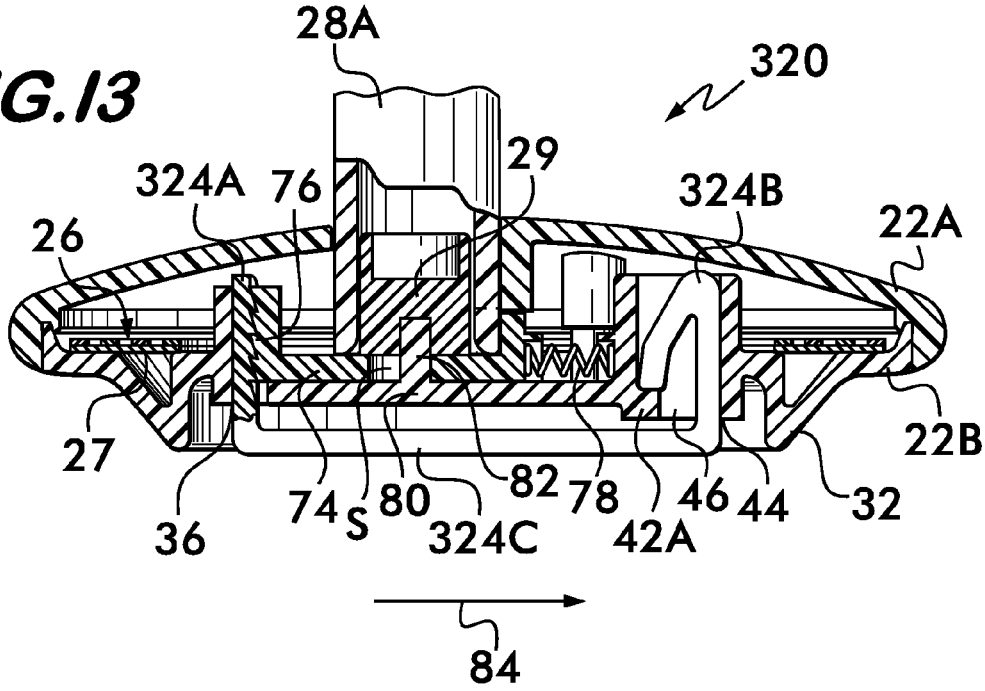
FIG. 13 is a cross-sectional view of the hard tag, similar to FIG. 5, but using a fourth variant of the attachment clip which uses a fluke on one end and ratchet teeth on the other.
Figure 14:
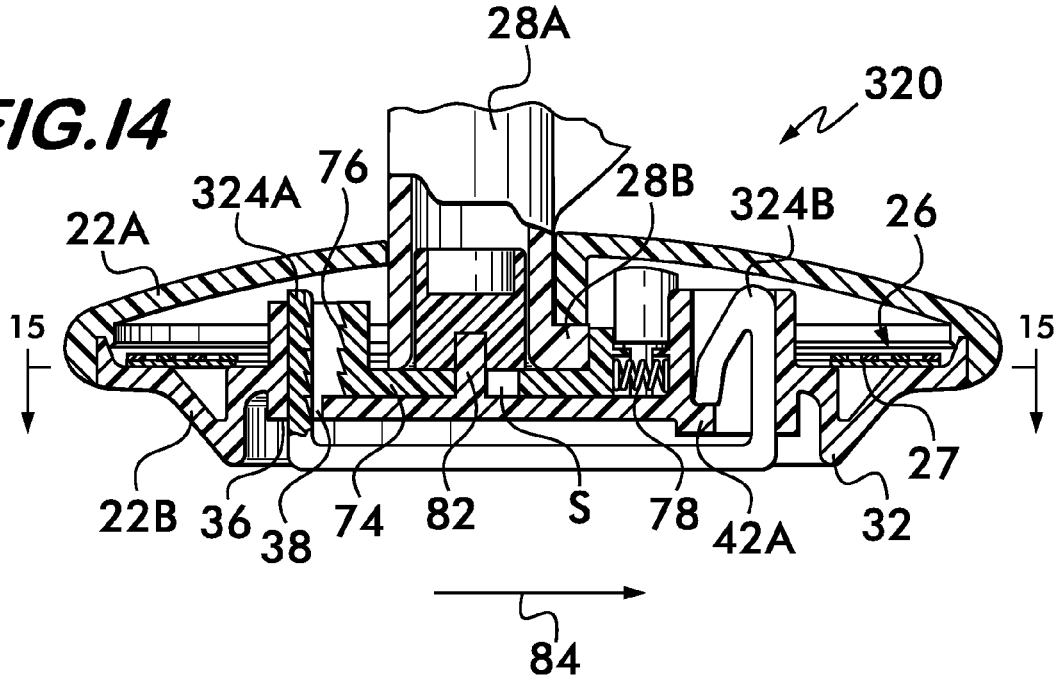
FIG. 14 is a cross-sectional view of the hard of FIG. 13 showing the rotation of the detacher disengaging the ratchet teeth to release the attachment clip.
Figure 15:
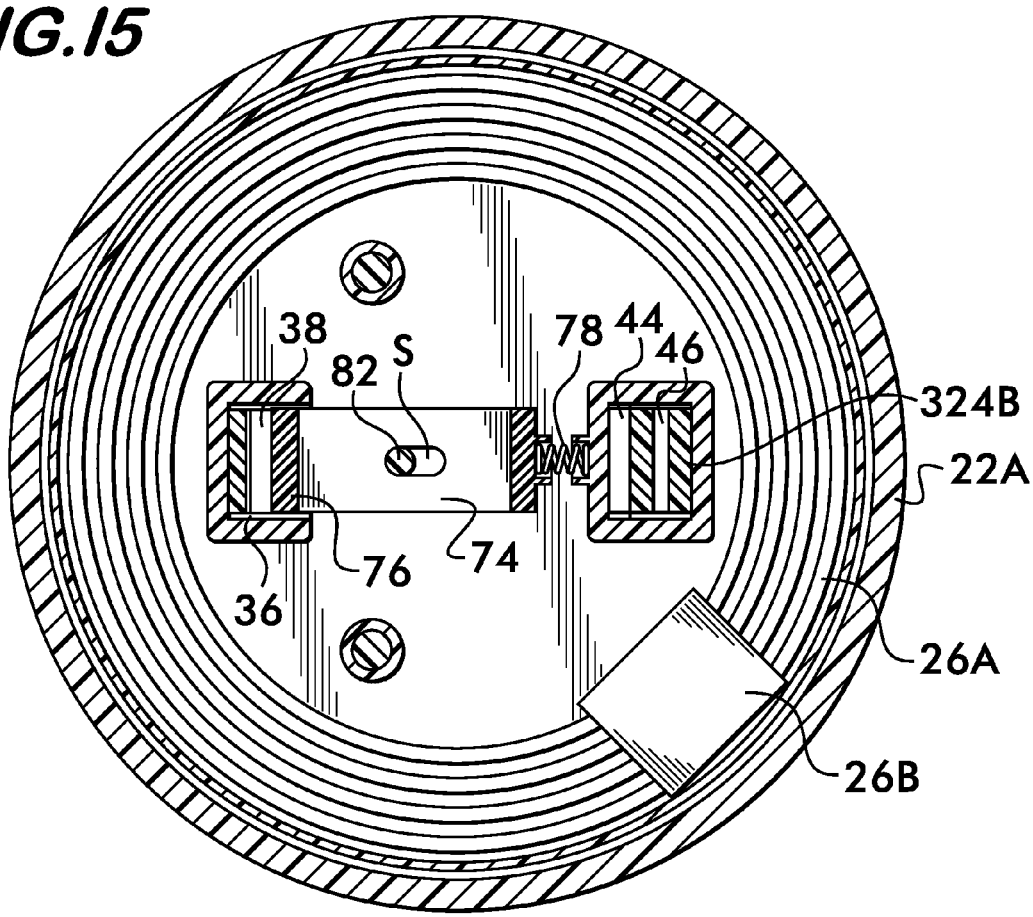
FIG. 15 is a plan cross-sectional view of the hard tag taken along line 15-15 of FIG. 14.

FIGS. 13-15 depict another security hard tag 320 which uses an attachment clip 324 having stems 324D/324E that are perpendicular to the clip segment 324C. In this embodiment, a fluke 324B is inserted into the aperture 36 and through the opening 38, as discussed previously, where it locks against the stop 42A. The other end 324A of the attachment clip 324 comprises ratchet teeth. The end 324A is inserted into the aperture 36 which causes a sliding member 74 having matching ratchet teeth 76 to be displaced in the direction of the arrow 84 against the bias of a spring 78, while locking the end

324A within the security hard tag 320. In order to disengage the sliding member ratchet teeth 76 from the ratchet teeth of the clip end 324A, the sliding member 74 must be displaced away from the end 324A. The sliding member 74 slides on a fixed inverted "T" element 80 that is coupled to the post 29. A slot S (most clearly shown in FIG. 15) in the sliding member 74 allows for movement of the member 74 around the central post 82 of the inverted T element 80. To remove the security hard tag 320 from the article, the detacher 28 is inserted into the opening 30 (FIG. 13) and then rotated (FIGS. 14-15) which compresses the spring 78 and displaces the sliding member 74 in the direction of the arrow 84, thereby disengaging the ratchet teeth 76 of the sliding member 74 from those of the attachment clip end 324A. Thus, the attachment clip end 324A can then be removed from the aperture 36.

Figure 16:
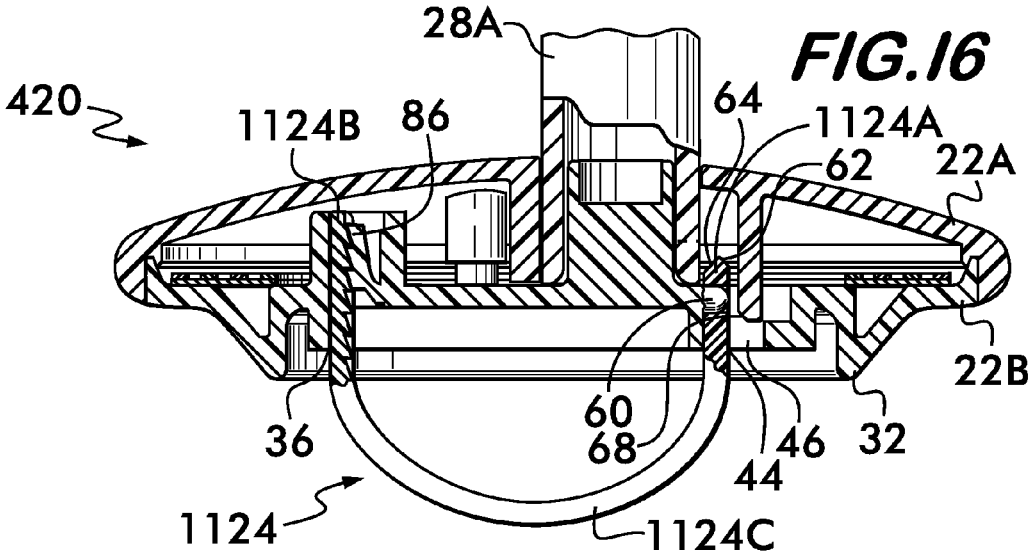
FIG. 16 is a cross-sectional view of the hard tag, similar to FIG. 5, but using a fifth variant of the attachment clip which uses a flexible portion having ratchet teeth at one end and a hole at the other end.

FIG. 16 depicts another embodiment of the security hard tag 420 wherein another attachment clip 1124 is used to secure the tag 420 to an article. As with the attachment clip 1224, the attachment clip 1124 does not include stems that form a right angle with the clip segment 1124C. In this tag 420, the attachment clip end 1124B comprises ratchet teeth that engage in corresponding ratchet teeth 86 located inside the aperture 36, thereby locking the attachment clip end 1124B into the security hard tag 420. The other end 1124A of the attachment clip 1124 comprises the aperture 125 and comprises the dual tapered top surface 62/64, as discussed previously with regard to the security hard tag 120 discussed earlier. Similarly, the opening 46 comprises the downwardly-depending, flexible flange 68 having the tapered edge 66. FIG. 16 depicts the apertured end 1124A captured on the pin 60 with the detacher 28 inserted but not turned. Disengagement of the apertured end 1124A is similar to that discussed previously with regard to the security hard tag 120 and, as such, is not repeated here.

Figure 17:
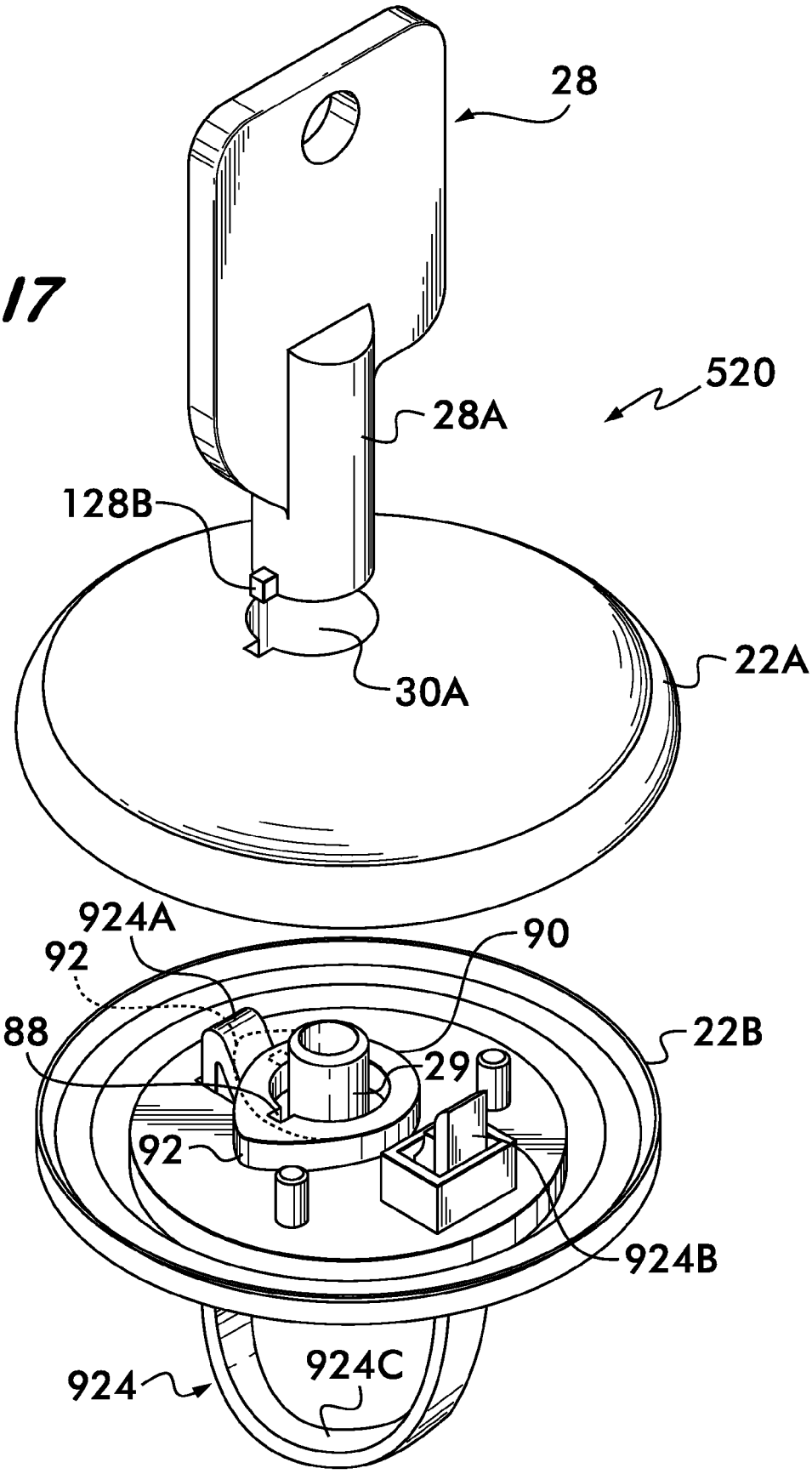
FIG. 17 is an exploded view of the hard of FIG. 16 showing the use of an internal rotatable cam member with the detacher.

FIG. 17 depicts an exploded view of another embodiment of the security hard tag 520 wherein the cam 28B positioned on the distal end of the detacher shank 28A is replaced with a key element 128B that fits into a corresponding cavity 88 in a rotatable cam member 90. The opening 30A permits entry of the distal end of the detacher 28 having the key element 128B and is also different than the opening 30 discussed previously. Thus, the cam member 90 is rotatable about the post 29 and remains inside the housing 22 of the security hard tag 520. When the detacher 28 is inserted and the key element 128B passes into the cavity 88, the detacher 28 can be rotated which rotates the cam member 90, causing the cam surface 92 to engage one end (e.g., a fluke end 924A of the attachment clip 924, FIG. 18) of an attachment clip that compresses the fluke 924A to disengage and "pop" the fluke 924A out of its corresponding opening to release the security hard tag 520 from the article (not shown) to which it is attached. Thus, the security hard tag 520 provides an alternative cam mechanism which remains inside the housing 22 rather than being part of the detacher 28 itself.

FIG. 18 depicts the various types of attachment clips that can be used in the different security hard tags 20-520 discussed previously. These are shown by way of example only as are the various releasable securement mechanisms for one end of the attachment clips. It should be understood that the end of the attachment clip that is releasably secured within the housing 22 has been designated with an "A" in the reference number (e.g., 24A, 124A, 224A, 324A, 924A, 1124A, 1224A) while the other end of the attachment clip that remains locked within the housing 22 has been designated with a "B" in the reference number (e.g., 24B, 124B, 324B, 924B, 1124B, 1224B). However, it is within the broadest scope of the present invention to reverse this such that the "B" ends are releasable and the "A" ends remain locked in the housing 22. The important feature is that one of the attachment clip ends is releaseable while the other end remains locked within the housing 22. Although not depicted in any of the other embodiments, it should be understood that attachment clips 224, 324, 424, 524, 624, 724, 824 and 1024 can be used in the various security hard tags 20-520 and depending on which end of the attachment clip is to be releasable and which is to remain locked within the housing 22, the operation of such releasable securement can be understood in light of the foregoing discussion. Thus, the embodiments 20-520 are by way of example only and other variations of the se security hard tags are within the broadest scope of the present invention using any of the attachment clips shown herein.

As mentioned previously, the security hard tags, e.g., 20-520, may be re-usable or disposable.

It should be understood that, although a less preferred embodiment, it is within the broadest scope of the security hard tag of the present invention to include the use of ferrous materials or metals in the housing 22 and/or attachment clips 24-1224 or security elements 26.

In addition, although the preferred method for using the security hard tag is to lock one end of the attachment clip into the housing 22 initially and then to interface the other end of the attachment through or around the article (or security tag loop 500) and then to releasably secure the second end within the housing 22 (thus preventing a choking hazard), it should be understood that it is within the broadest scope of the invention to interface one end of the attachment clip through or around the article (or security tag loop 500) first and then to lock each end of the attachment clip within respective apertures in the housing 22.

While the invention has been described in detail and with reference to specific examples thereof, it will be apparent to one skilled in the art that various changes and modifications can be made therein without departing from the spirit and scope thereof.

What is claimed is:

1. A security hard tag adapted for securing to an article, said security tag comprising:

a housing;

a locking mechanism contained within said housing;

an attachment clip having ends that secure within said locking mechanism and wherein one of said ends is passed through or around the article being protected before said one of said ends is secured within said housing, wherein said attachment clip is non-metallic;

a security element associated with said housing, said security element preventing or hindering a theft of the article; and a detacher that is engageable within said housing for unlocking said locking mechanism and releasing one of said ends of said attachment clip.

2. The security hard tag of claim 1 wherein at least one of said ends of said attachment clip comprises a fluke that compresses as it passes through a first aperture in said housing and expands once it passes through said first aperture.

3. The security hard tag of claim 2 wherein the other one of said ends comprises another fluke that compresses as it passes through a second aperture in said housing and expands once it passes through said second aperture.

4. The security hard tag of claim 2 wherein the other one of said ends comprises a plurality of teeth that engage a corresponding plurality of teeth within a second aperture in said housing.

5. The security hard tag of claim 2 wherein the other one of said ends comprises a hole that engages a pin positioned within a second aperture in said housing.

6. The security hard tag of claim 1 wherein at least one of said ends of said attachment clip comprises a hole that engages a pin positioned within a first aperture in said housing.

7. The security hard tag of claim 6 wherein the other one of said ends comprises another hole that engages a pin positioned within a second aperture in said housing.

8. The security hard tag of claim 6 wherein the other one of said ends comprises a plurality of teeth that engage a corresponding plurality of teeth within a second aperture in said housing.

9. The security hard tag of claim 1 wherein each of said ends of said attachment clip comprises a respective plurality of teeth, each of said respective plurality of teeth engaging a corresponding plurality of teeth positioned in as first and second aperture in said housing.

10. The security hard tag of claim 3 wherein each end of said attachment clip forms a right angle to a clip segment.

11. The security hard tag of claim 4 wherein each of said ends of said attachment clip forms a right angle to a clip segment.

12. The security hard tag of claim 5 wherein each of said ends of said attachment clip forms a right angle to as clip segment.

13. The security hard tag of claim 7 wherein each of said ends of said attachment clip forms a right angle to a clip segment.

14. The security hard, tag of claim 8 wherein each of said ends of said attachment clip forms a right angle to a clip segment.

15. The security hard tag of claim 9 wherein each of said ends of said attachment clip forms a right angle to is clip segment.

16. The security hard tag of claim 1 wherein said detacher comprises a cam disposed on a distal end thereof, said cam engaging one of said ends of said attachment clip to unlock said one of said ends when said distal end is rotated.

17. The security hard tag of claim 1 wherein said housing comprises is cam member that is rotatable within said housing for engaging one of said ends of said attachment clip to unlock said one of said ends, said cam member receiving a distal end of said detacher which rotates said cam member.

18. The security hard tag of claim 2 wherein said fluke comprises a barb having an end that seats against a stop positioned in said housing once said fluke expands.

19. The security hard tag of claim 18 wherein said barb comprises a bridge line that joins two differently-oriented surfaces of said barb, said bridge line causing said fluke to pass out of said first aperture when said bridge line is compressed.

20. The security hard tag of claim 5 wherein said detacher comprises a cam disposed on a distal end thereof, said cam engaging the other one of said ends to drive the other one of said ends off said pin positioned within a second aperture when said distal end is rotated.

21. The security hard tag of claim 4 wherein said corresponding plurality of teeth within said second aperture form a portion of an element that is displaceable within said housing and wherein said detacher comprises a cam disposed on distal end thereof, said cam engaging said element, to displace said corresponding plurality of teeth away from said plurality of teeth on said other end of said attachment clip when said distal end is rotated.

22. The security hard tag of claim 1 wherein said attachment clip comprises as first end that is locked into said housing via an aperture and wherein a second end of said attachment clip is releasably inserted through a slot that is parallel to a bottom surface of said security hard tag.

23. The security hard tag of claim 22 further comprises a pivotal ratchet element disposed within said slot, said second end of said attachment clip comprising a plurality of teeth for engaging with said pivotal ratchet element.

24. The security hard tag of claim 23 wherein said detacher comprises a cam disposed on a distal end thereof, said cam engaging said pivotal ratchet element to disengage said pivotal ratchet element from said plurality of teeth in said second end of said attachment clip.

25. The security hard tag of claim 1 comprising a outwardly-depending skirt, said outwardly-depending skirt forming a cavity into which said attachment clip is positioned when said ends of said attachment clip are locked into said housing.

26. The security hard tag of claim 1 wherein said security tag responds to a magnetic or electromagnetic field of a particular frequency or frequencies.

27. The security hard tag of claim 26 wherein said security element comprises an electronic article surveillance (EAS) element, or a radio frequency identification (REID) element or a combination of both.

28. The security hard tag of claim 27 wherein said EAS element comprises an acoustomagnetic element, a radio frequency element, an electromagnetic element or a microwave element or any combination thereof.

29. The security hard tag of claim 27 wherein said RFID element comprises a low frequency element, a high frequency element or an ultrahigh frequency element or any combination thereof.

30. The security hard tag of claim 1 wherein said security element comprises a benefit-denial security element.

31. The security hard tag of claim 30 wherein said benefit-denial security element comprises an ink-filled or dye-filled member.

32. The security hard tag of claim 30 wherein said benefit-denial security element comprises a visual, audible or tactile alarm.

33. The security hard tag of claim 1 wherein said housing is non-ferrous.

34. The security hard tag of claim 33 wherein said locking mechanism is non-ferrous.

35. The security hard tag of claim 34 wherein said security element is non-ferrous.

36. A method for attaching a security hard tag to an article, said method comprising:

providing a housing comprising a locking mechanism and a security element associated therewith, said security preventing or hindering a theft of the article;

locking a first end of an attachment clip within said housing, wherein said attachment clip is non-metallic;

passing a second end of said attachment clip through or around the article; and releasably securing said second end of said attachment clip into said housing.

37. The method of claim 36 wherein said step of passing a second end of said attachment clip through or around the article occurs before said step of locking a first end of an attachment clip within said housing.

38. The method of claim 36 wherein said step of locking a first end of said attachment clip with said housing comprises permanently locking said first end within said housing.

39. The method, of claim 37 wherein said step of locking a first end of said attachment clip with said housing comprises permanently locking said first end within said housing.

40. The method of claim 36 wherein said step of releasably securing said second end of said attachment clip comprises inserting a detacher having a distal end into said housing that contacts said second end to disengage said second from said housing when, said distal end is rotated.

41. The method of claim 36 wherein said step of releasably securing said second end of said attachment clip comprises inserting a detacher having a distal end into said housing that engages an internal rotatable cam member that contacts said second end to disengage said second from said housing when said distal end is rotated.

42. The method of claim 40 wherein said second end comprises a deformable barb having a bridge line that joins two differently-oriented surfaces on said barb, and wherein said step of releasably securing said second end comprises rotating said distal end of said detacher to deform said barb along said bridge line to release said second end while causing said second end to partially emerge from said housing in one action.

43. The method of claim 40 wherein said second end comprises a plurality of teeth that engage a displaceable element comprising a corresponding plurality of teeth and wherein said step of releasably securing said second end comprises rotating said distal end of said detacher to displace said element away from said plurality of teeth of said second end.

44. The method of claim 40 wherein said second end comprises a plurality of teeth that engage a pivotable element having a plurality of teeth and wherein said step of releasably securing said second end comprises rotating said distal end of said detacher to pivot said pivotable element to disengage said plurality of teeth on said pivotable element from said plurality of teeth on said second end.

45. The method of claim 40 wherein said second end comprises an aperture that passes over pin positioned within said housing and wherein said step of releasably securing said second end comprises rotating said distal end of said detacher to disengage said second end off of said pin.

46. The method of claim 36 wherein said step of releasably securing said second end comprises positioning said attachment clip within a skirt of said housing that prevents the introduction of cutter jaws over and under said attachment clip.

47. The method of claim 36 wherein said security element responds to a magnetic or electromagnetic field of a particular frequency or frequencies.

48. The method of claim 36 wherein said security element ejects ink or dye on the article.

49. The method of claim 36 wherein said security element emits a visual or audible or tactile alarm.

50. The method of claim 36 wherein said step of providing a housing comprises providing a non ferrous housing.

51. The method of claim 50 wherein said step of providing a housing comprises providing a non-ferrous locking mechanism.

52. The method of claim 51 wherein said step of locking a first end of an attachment clip within said housing comprises locking a first end of said attachment clip within said housing.

53. The method of claim 37 wherein said step of locking a first end of an attachment clip within said housing comprises locking a first end of said attachment clip within said housing.

54. The method of claim 52 wherein said step of providing a housing comprises providing a non-ferrous security element.

55. The security hard tag of claim 1, wherein the article comprises a loop, said loop being located in a concealed portion of the article when said article is on display or presentation, said loop being fixedly or releasably secured to the article and around or through, and wherein one of said ends is passed through said loop.

56. A security hard tag adapted securing to an article, said security tag comprising:

a housing;

a locking mechanism contained within said housing;

an attachment clip having, ends that secure within said locking mechanism and wherein one of said ends is passed through or around the article being protected before said one of said ends is secured within said housing, wherein said attachment clip is non-metallic;

a security element associated with said housing, said security element preventing or hindering a theft of the article; and a outwardly-depending skin, said outwardly-depending skirt forming a cavity into which said attachment clip is positioned when said ends of said attachment clip are locked into said housing.

* * * * *

UNITED STATES PATENT AND TRADEMARK OFFICE

CERTIFICATE OF CORRECTION

PATENT NO. : 8,344,891 B2
APPLICATION NO. : 12/482934
DATED : January 1, 2013
INVENTOR(S) : Appalucci et al.

It is certified that error appears in the above-identified patent and that said Letters Patent is hereby corrected as shown below:

Title Page, In the Abstract, the phrase "A security hard tag, uses an attachment clip to couple to an article, such as but not limited to clothing, to be protected . . ." should read "A security hard tag uses an attachement clip to couple to an article, such as, but not limited to, clothing, to be protected . . .".

In the Specification, col. 4, line 27, the phrase "frequencies, or operates" should read "frequencies), or operates".

In the Specification, col. 4, lines 43-44, the phrase "chocking hazard" should read "choking hazard".

In the Specification, col. 10, line 12, the phrase "variations of the se" should read "variations of these".

In the Claims, col. 11, line 19, the phrase "teeth positioned in as first" should read "teeth positioned in a first".

In the Claims, col. 11, line 27, the phrase "right angle to as clip" should read "right angle to a clip".

In the Claims, col. 11, line 36, the phrase "right angle to is clip" should read "right angle to a clip".

In the Claims, col. 11, line 43, the phrase "comprises is cam" should read "comprises a cam".

In the Claims, col. 12, line 2, the phrase "clip comprises as first" should read "clip comprises a first".

In the Claims, col. 12, line 26, the phrase "radio frequency identification (REID)" should read as "radio frequency identification (RFID)".

In the Claims, col. 12, line 53, the phrase "said security element associated therewith, said security" should read "said security element associated therewith, said security element".

In the Claims, col. 13, line 7, the phrase "to disengage said second from" should read "to disengage said second end from".

In the Claims, col. 13, line 13, the phrase "to disengage said second from" should read "to disengage said second end from".

In the Claims, col. 14, line 9, the phrase "providing a non ferrous" should read "provind a non-ferrous".

In the Claims, col. 14, line 40, the phrase "a outwardly-depending skin" should read "an outwardly-depending skirt".

Signed and Sealed this
Fifteenth Day of October, 2013

Teresa Stanek Rea
*Deputy Director of the United States Patent and Trademark Office*